United States Patent [19]

Hagel et al.

[11] Patent Number: 4,956,029

[45] Date of Patent: Sep. 11, 1990

[54] ELECTRICALLY PRIMABLE IGNITER CHARGES FOR CASELESS AMMUNITION AND PROPELLANT CARTRIDGES

[75] Inventors: Rainer Hagel, Lichtenfels; Klaus Redecker, Nuremberg; Horst Penner, Furth, all of Fed. Rep. of Germany

[73] Assignee: Dynamit Nobel Aktiengesellschaft, Troisdorf, Fed. Rep. of Germany

[21] Appl. No.: 166,985

[22] Filed: Mar. 11, 1988

[30] Foreign Application Priority Data

Mar. 11, 1987 [DE] Fed. Rep. of Germany ..... 3707694

[51] Int. Cl.[5] ..... C06B 45/10; F42C 19/12

[52] U.S. Cl. ..... 149/19.8; 149/19.1; 149/23; 149/27; 149/28; 102/202.5

[58] Field of Search ..... 149/19.1, 19.8, 23, 149/27, 28; 102/202.5

[56] References Cited

U.S. PATENT DOCUMENTS

| | | | |
|---|---|---|---|
| 3,002,457 | 10/1961 | Doughty | 102/202.5 |
| 4,016,018 | 4/1977 | Lenotre | 149/19.1 |
| 4,072,546 | 2/1978 | Winer | 149/19.8 |
| 4,363,679 | 12/1982 | Hagel et al. | 149/37 |
| 4,402,268 | 9/1983 | Usel | 149/19.8 |
| 4,581,082 | 4/1986 | Hagel et al. | 149/37 |
| 4,644,863 | 2/1987 | Bender et al. | 102/202.5 |
| 4,812,179 | 3/1989 | Sayles | 149/19.8 |
| 4,817,828 | 4/1989 | Goetz | 102/288 |

*Primary Examiner*—Edward A. Miller

*Attorney, Agent, or Firm*—Antonelli, Terry, Stout & Kraus

[57] ABSTRACT

An electrically primable igniter charge yield has a composition that yields a reduced proportion of toxic vapors after the deflagration. The composition of the charges contains, as the oxidizing agent, zinc peroxide and, as a component providing additional energy, initiating explosives of the kind which do not trigger a detonation in direct contact with press-molded elements of nitrocellulose propellant charge powders. Among these initiating explosives are the potassium salts of trinitrophenol or trinitroresorcinol. The components of the igniter charges are mixed with fibers of an electrically conductive material. Suitable conductive materials are carbon or metals, such as iron or copper, or metal alloys, such as brass, for example. The igniter charges furthermore contain a binder which is preferably a secondary explosive, such as, for example, nitrocellulose.

8 Claims, No Drawings

ELECTRICALLY PRIMABLE IGNITER CHARGES FOR CASELESS AMMUNITION AND PROPELLANT CARTRIDGES

The present invention relates electrically primable igniter charges containing oxidizing agents in a mixture with initiating explosives and binders. Additional components of the igniter charges are conventional reducing agents, secondary explosives, and inert materials. These igniter charges are utilized for the electrical ignition of caseless ammunition or propellant cartridges.

Caseless, electrically primable ammunition is known per se and has gained increasing interest especially in the smaller caliber range on the order around 5 mm. Ignition of the cartridge can herein be effected by igniters of an electrically conductive material in fine distribution (British Patent No. 1,389,392) or by a corresponding coating, the high electric resistance of which triggers ignition upon passage of current (DOS No. 2,206,468). The disadvantage of these known ignition systems resides in a more or less high proportion of toxic products in the reaction vapors.

Propellant cartridges are utilized for stud drivers or for cattle stunning. The practical embodiment of a caseless propellant cartridge consists of a pressed propellant charge of nitrocellulose propellant charge powder connected to a primer pellet. The pellet can contain initiating explosives to accelerate the reaction, and antimony crystals of a special specification to initiate the reaction.

An object of the present invention resides in developing igniter charges for caseless ammunition and for propellant cartridges which can be ignited electrically and the vapors of which contain a reduced proportion of toxic compounds. Furthermore, the evolving vapors are to be free of aggressive gases.

In attaining this object, electrically primable igniter charges, containing oxidizing agents in a mixture with initiating explosives and binders, have now been found which are characterized in that they contain, as the oxidizing agent, zinc peroxide; as the initiating explosives, those which do not trigger a detonation in direct contact with a propellant charge powder molding; and as conductive material, conductive fibers.

Although igniter charges containing zinc peroxide and special initiating explosives usable for the igniting of caseless ammunition, are known from DE No. 33 21 943-A1, such charges can be made to react, on account of their composition, only by a mechanical action. Electrical ignition of these known charges is impossible.

The initiating explosives, usable according to the invention, are those which do not trigger detonation when in direct contact with a press-molded element of nitrocellulose propellant charge powder. This is understood to mean a reaction wherein the transformation of an explosive compound is coupled with a shock wave so that a detonation is instantaneously initiated. Initiating explosives wherein this reaction cannot occur and which are therefore suited for use in the present electrical igniter charges are, for example, the potassium salts and strontium salts of trinitrophenol and of trinitroresorcinol which can be substituted by diazodintrophenole up to 50% by weight. Also are the lead salts of trinitroresorcinol in the normal or basic form, insofar as a small proportion of lead can be tolerated in the vapors. The proportion of such lead salts, however, should be restricted to amounts below 20% by weight in the igniter charge.

The initiating explosives can be contained in the igniter charges of this invention in quantities of between 20 and 70% by weight based on the total weight of the charge. They can be used in fine-grained as well as coarse-grained condition.

Zinc peroxide is employed as the oxidizing agent in the igniter charges of this invention. This compound has preferably an active oxygen content of more than 12.3%. The production of such zinc peroxide is described in German Patent No. 2,952,069, and corresponding U.S. Pat. No. 4,363,679, the disclosure of which is incorporated herein by reference.

The amount of zinc peroxide in the igniter charge of this invention can vary between 5 and 70% by weight based on the total weight of the charge. The zinc peroxide can be used in the fine-grained as well as coarse-grained condition.

The igniter charges according to this invention can furthermore additionally contain reducing agents or other components contributing toward the reaction, as well as various inert materials.

Suitable reducing agents are the conventional reducing compounds in igniter charges bringing about an improvement in the ignition capability. Suitable materials are, for example: metallic powders of titanium, zirconium, magnesium, cerium-magnesium, cerium-silicon, or aluminum-magnesium alloys. The proportions of the reducing agent in the igniter charge can be 0–20% by weight.

Primarily suitable as additional components contributing toward the reaction are secondary explosives, such as, for example, nitrocellulose or pentaerythritol tetranitrate. Nitrocellulose is preferably employed, in this connection, acting simultaneously as a binder. Also other secondary explosives exhibiting binder properties as e.g. polynitropolyphenylene or polyvinylnitrate or nitrated aromatic polyethers according to the invention. Such secondary explosives with binder properties are contained in the igniter charges of the invention in proportions of between 1 an 30% by weight.

As binders without explosive properties are suitable e.g.: polyvinylbutyrale, polyvinylacetate, celluloseacetate and similar compounds.

Secondary explosives without binder properties can likewise be present in the igniter charges of this invention. Examples that can be cited are octogen as well as amino compounds of nitrated aromatics, e.g. of trinitrobenzene, such as mono- , di- or triaminotrimitrobenzene or diaminohexanitrodiphenyl, furthermore the acylation products of these compounds, such as for example, hexanitrooxanilide or hexanitrodiphenylurea. Additional examples of these secondary explosives are hexanitrostilbene, hexanitrodiphenyl oxide, hexanitrodiphenyl sulfide, hexanitrodiphenylsulfone, and hexanitrodiphenylamine, as well as tetranitrocarbazole, or tetranitroacridone, or polyvinyl nitrate. The proportion of these compounds in the igniter charge can amount to 0–30% by weight.

Suitable inert materials are the substances conventional in igniter systems, also used at the same time for adapting the properties of these charges to the respective usage. Among the inert materials are furthermore other binders, adhesives and colorants, as well as the already recited passivators. The proportion of inert materials in the igniter charges of this invention can vary between 0 and 20% by weight.

The claimed igniter charges furthermore contain fibers of a conductive material. A suitable conductive material in this connection is carbon as well as a metal conductive for electric current, or a suitable alloy, e.g. brass. Usable metallic fibers are, for example, those of iron or copper. The thickness and length of the fibers are chosen so that an adequate number of rounds fired is possible with the current source utilized in ignition. If necessary, the fibers can be mechanically comminuted and distributed in an inert medium before the mixing step. This inert medium can also be constituted by one of the aforementioned binders. Comminution is advantageously accomplished by using an "Ultra-Turras" device. Another form of using the fibers resides in the application of orderly fibers in the shape of, for example, nets or woven structures.

The proportion of fibers in the igniter mixture can range between 0.5 and 20% by weight based on the total weight of the charge.

The igniter charges according to this invention are produced according to conventional methods by mixing the initiating explosive, oxidizing agent, fibers, and optionally the remaining components of the mixture with the binder, dissolved in known solvents, for these binders; this binder can be simultaneously a secondary explosive, e.g. nitrocellulose. This mixing step can be performed by known processes, using agitation, kneading, or similar distributing methods. In these processes, the igniter charge is obtained as a pasty composition which can then be applied to a caseless propellant charge powder element.

The igniter charges, primable electrically, in accordance with this invention not only fulfill the function of an igniter charge but can also be joined without an additional booster charge directly with caseless propellant charge moldings of, for example, nitrocellulose, which can also contain a projectile. This is generally done by the direct application of a charge according to this invention by means of a metering device, such as pipettes, syringes, or similar means. In this step, the presence of solvents which, for example, dissolve nitrocellulose superficially, effect a direct, mechanically firm bond between the electrically primable igniter charge and the press-molded propellant charge.

Instead of applying the igniter charge with syringes, pipettes or the like, a pestle can also be used which, after having been dipped into the igniter charge, transfers the mixture adhering to it onto the propellant charge powder element.

Another application method for the igniter charges of this invention uses, for example, screens, through which a pasty composition can be forced, as in the screen printing procedure.

Moreover, the igniter mixture can be cast, rolled or extruded into strips or sheets. From these, after drying, primer pellets are punched out in the correct shape; these pellets are then combined with solvents which dissolve nitrocellulose or already contain the latter along the lines of adhesives, and are then fastened to the formed propellant powder charges.

The residues of the igniter charges remaining after the afore-described application method can be directly admixed to new batches, after having been treated with solvents.

The invention will be described in greater detail with reference to the following:

EXAMPLE 1 (PREPARATION OF THE RAW MATERIALS)

Potassium picrate is precipitated by reacting magnesium picrate with potassium nitrate or potassium sulfate in a aqueous solution, filtered, and washed free of magnesium salt with water, and the water is displaced by ethanol. In this form, the potassium picrate is stored (alcohol moisture about 30–40% by weight).

A carbon fiber is comminuted in water with a soap that does not foam by means of an "Ultra-Turrax" agitator to a fiber length of $<3$ mm. In order to avoid heating up of the agitator, the agitator is allowed to run for 30 minutes at 75% maximum number of revolutions.

EXAMPLE 2 (PRODUCTION OF ELECTRICALLY PRIMABLE IGNITER CHARGE)

3.5 g of the potassium picrate (calculated as dry weight) in about 30–40% by weight of ethyl alcohol, 0.5 g of zinc peroxide of an average particle size of about $15.10^{-6}$ m, 0.5 g of titanium powder, and 0.8 g of the carbon fiber are combined with a solution of 1 g of nitrocellulose (nitrogen content 13.5%) in 39 g of a solvent mixture of butyl acetate and ethyl acetate (1:1) and are homogenized. This batch is applied to a press-molded nitrocellulose article in accordance with one of the aforementioned methods. Charges produced in this way were conventionally made to react with an ignition electrode with capacitor charges of 100 or 200 $\mu$F at 40 volts.

What is claimed is:

1. An electrically primable igniter charge which comprises an oxidizing agent in a mixture with an initiating explosive, a conductive material and a binder, the charge containing 5 to 70% by weight of zinc peroxide as the oxidizing agent; as the initiating explosive, 20 to 70% by weight of an explosive which does not trigger a detonation in direct contact with a nitrocellulose propellant charge powder molding; 0.5 to 20% by weight of the conductive material consisting of electrically conductive fibers; and 1 to 30% by weight of the binder.

2. An igniter charge according to claim 1, wherein the charge contains, as the initiating explosive, a potassium salt of trinitrophenol and/or of trinitroresorcinol, or a lead salt of trinitroresorcinol.

3. An igniter charge according to claim 1, wherein the electrically conductive fibers are carbon fibers.

4. An igniter charge according to claim 2, wherein the electrically conductive fibers are carbon fibers.

5. An igniter charge according to claim 1, wherein the charge contains nitrocellulose as the binder.

6. An igniter charge according to claim 1, wherein the charge also contains 0 to 20% by weight of a powdered reducing agent.

7. An igniter charge according to claim 1, wherein said binder comprises a secondary explosive with binder properties.

8. An igniter charge according to claim 1, wherein the charge further contains 0 to 30% by weight of secondary explosives without binder properties.

* * * * *